US011396894B2

(12) United States Patent
Dwornik et al.

(10) Patent No.: US 11,396,894 B2
(45) Date of Patent: Jul. 26, 2022

(54) HYDRAULIC SHIELD SUPPORT SYSTEM AND PRESSURE INTENSIFIER

(71) Applicant: Caterpillar Global Mining Europe GmbH, Lünen (DE)

(72) Inventors: Oliver Dwornik, Selm (DE); Franz-Heinrich Suilmann, Werne (DE); Henner Rueschkamp, Lünen (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 0 days.

(21) Appl. No.: 16/976,170

(22) PCT Filed: Mar. 8, 2019

(86) PCT No.: PCT/EP2019/025065
§ 371 (c)(1),
(2) Date: Aug. 27, 2020

(87) PCT Pub. No.: WO2019/179663
PCT Pub. Date: Sep. 26, 2019

(65) Prior Publication Data

US 2020/0408226 A1 Dec. 31, 2020

(30) Foreign Application Priority Data

Mar. 19, 2018 (EP) ..... 18162613

(51) Int. Cl.
*E21D 23/26* (2006.01)
*F15B 3/00* (2006.01)
(Continued)

(52) U.S. Cl.
CPC ..... *F15B 3/00* (2013.01); *E21D 15/44* (2013.01); *E21D 15/45* (2013.01); *E21D 23/26* (2013.01);
(Continued)

(58) Field of Classification Search
CPC ..... E21D 23/16; E21D 23/26
(Continued)

(56) References Cited

U.S. PATENT DOCUMENTS 4,082,368 A 4/1978 Funk
4,921,306 A 5/1990 Tomlin
(Continued)

FOREIGN PATENT DOCUMENTS

DE 2810724 A1 9/1979
DE 102007017865 A1 10/2008
(Continued)

OTHER PUBLICATIONS

International Search Report for related International Application No. PCT/EP2019/025065; dated Jul. 4, 2019.
(Continued)

*Primary Examiner* — Sunil Singh

(57) ABSTRACT

In a hydraulic shield support system, a plurality of pressure intensifiers are respectively provided for a plurality of hydraulic props. Each pressure intensifier is operated to increase a system pressure to an increased pressure for supplying fluid at the increased pressure to a pressure chamber of the associated hydraulic prop. The plurality of pressure sensors measure the pressures of the fluid supplied to the respective hydraulic props. A control unit sets a plurality of desired pressures for the plurality of hydraulic props, and stops operation of the respective pressure intensifiers when the set desired pressure has been reached.

6 Claims, 3 Drawing Sheets

(51) Int. Cl.
*E21D 15/44* (2006.01)
*E21D 15/45* (2006.01)
*E21D 23/04* (2006.01)

(52) U.S. Cl.
CPC ... *E21D 23/0418* (2013.01); *F15B 2211/3057* (2013.01)

(58) Field of Classification Search
USPC ..... 405/288, 291, 302; 91/170 MP, 171, 91/300, 297, 319, 390
See application file for complete search history.

(56) References Cited

U.S. PATENT DOCUMENTS 5,258,913 A * 11/1993 Baldauf ..... B66C 23/80 701/37
6,295,914 B1 10/2001 Iversen
6,776,080 B2 8/2004 Hansen et al.
6,866,485 B2 3/2005 Hansen et al.
7,237,983 B2 7/2007 Suilmann et al.
7,428,861 B2 9/2008 Dettmers et al.
2004/0115070 A1 6/2004 Baatrup et al.
2004/0258487 A1* 12/2004 Suilmann ..... E21D 23/16 405/294
2006/0213363 A1 9/2006 Dettmers et al.
2017/0321728 A1 11/2017 Iversen

FOREIGN PATENT DOCUMENTS

EP 2565368 A1 3/2013
GB 912364 A 12/1962
GB 1593832 A 7/1981
GB 1594258 A 7/1981
WO WO 2010/005898 A1 1/2010

OTHER PUBLICATIONS

European Search Report for related EP Application No. 18162613.6; dated Dec. 12, 2018.

* cited by examiner

HYDRAULIC SHIELD SUPPORT SYSTEM AND PRESSURE INTENSIFIER

CROSS-REFERENCE TO RELATED APPLICATION

This Application is a 35 USC § 371 US National Stage filing of International Application No. PCT/EP2019/025065 filed on Mar. 8, 2019 which claims priority under the Paris Convention to European Patent Application No. 18162613.6 filed on Mar. 19, 2018.

TECHNICAL FIELD

The present disclosure generally relates to a hydraulic shield support system and a pressure intensifier for use therein, in particular, to a hydraulic shield support system for use in underground mining.

BACKGROUND

In underground mining systems, various hydraulic assemblies are used, for example, for controlling hydraulic functions of roof supports used in underground longwall mining. For example, a self-advancing roof support system may include at least two adjustable-length hydraulic props provided on base shoes and supporting a shield. In particular, such hydraulic supports are used to keep the face or working area free and to support the roof. Generally, the canopy or shield of the roof support is supported by double acting hydraulic props supported on the base shoes.

In view of a constant demand for longer faces and higher capacity systems, the roof surface area to be supported by the roof supports increases constantly. To support the rock, it is therefore necessary to increase the load that can be supported by the shields.

The disclosed systems and methods are directed at least in part to improving known systems.

SUMMARY OF THE DISCLOSURE

In one aspect, the present disclosure relates to a hydraulic shield support system adapted for underground mining. The system comprises a plurality of length-adjustable hydraulic props configured to support a shield, and a hydraulic fluid supply configured to supply hydraulic fluid at a first pressure. A plurality of pressure intensifiers are fluidly connected between the hydraulic fluid supply and each of the hydraulic props. Each of the plurality of pressure intensifiers is configured to supply hydraulic fluid at an increased second pressure to the associated hydraulic prop. A plurality of control valves are configured to selectively supply the hydraulic fluid from the hydraulic fluid supply to the respective pressure intensifiers to operate the same. Further, a plurality of pressure sensors are configured to measure the pressure of the hydraulic fluid supplied to each of the hydraulic props by the associated pressure intensifier. A control unit is configured to set a plurality of desired pressures of the hydraulic fluid to be supplied to the plurality of hydraulic props, at least two of the set desired pressures being different from each other. The control unit is further configured to receive the pressures measured by the plurality of pressure sensors, and to switch the plurality of control valves to stop supplying fluid to each of the pressure intensifiers when the measured pressure reaches the set desired pressure for the associated hydraulic prop.

In another aspect, the present disclosure relates to a method of operating a hydraulic shield support system adapted for underground mining, the system comprising a plurality of length-adjustable hydraulic props configured to support a shield, a hydraulic fluid supply configured to supply hydraulic fluid at a first pressure, a plurality of pressure intensifiers fluidly connected between the hydraulic fluid supply and each of the hydraulic props, each of the plurality of pressure intensifiers being configured to supply hydraulic fluid at an increased second pressure to the associated hydraulic prop, and a plurality of control valves configured to selectively supply the hydraulic fluid from the hydraulic fluid supply to the respective pressure intensifiers to operate the same. The method comprises setting a plurality of desired pressures of the hydraulic fluid to be supplied to the plurality of hydraulic props, at least two of the set desired pressures being different from each other, measuring the pressure of the hydraulic fluid supplied to each of the hydraulic props, and switching the plurality of control valves to stop supplying fluid at the first pressure to each of the pressure intensifiers when the measured pressure reaches the set desired pressure for the associated hydraulic prop.

In yet another aspect, the present disclosure relates to a pressure intensifier for use in a hydraulic shield support system. The pressure intensifier comprises a housing including a low-pressure input configured to receive hydraulic fluid at a first pressure, and a high-pressure output configured to output the hydraulic fluid at an increased second pressure. The pressure intensifier further comprises an intensifier piston movably disposed in the housing and defining a low-pressure chamber and a high-pressure chamber on opposite sides of the piston, the intensifier piston being configured to increase the pressure of hydraulic fluid in the high-pressure chamber by moving into the high-pressure chamber when hydraulic fluid at the first pressure is supplied to the low-pressure chamber. A directional control valve is movably disposed in the pressure intensifier, the directional control valve being movable between a first control valve position in which the low-pressure chamber is fluidly connected to the low-pressure input and a second control valve position in which the low-pressure chamber is fluidly connected to a drain. A switching valve is configured to switch the directional control valve between the first control valve position and the second control valve position, wherein the switching valve is configured to switch the directional control valve from the first control valve position to the second control valve position when the intensifier piston reaches a predetermined position in the high-pressure chamber.

Other features and aspects of the present disclosure will be apparent from the following description and the accompanying drawings.

DETAILED DESCRIPTION

Figure 1:
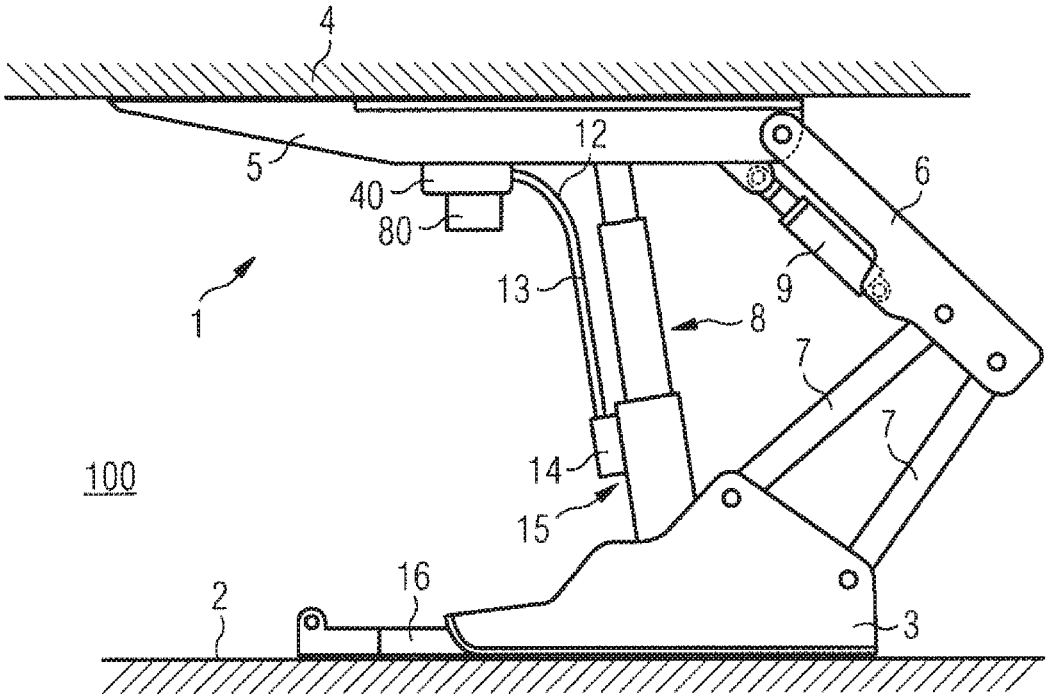
FIG. 1 shows a schematic side view of a shield support in accordance with the present disclosure.

The following is a detailed description of exemplary embodiments of the present disclosure. The exemplary embodiments described herein are intended to teach the principles of the present disclosure, enabling those of ordinary skill in the art to implement and use the present disclosure in many different environments and for many different applications. Therefore, the exemplary embodiments are not intended to be, and should not be considered as a limiting description of the scope of protection. Rather, the scope of protection shall be defined by the appended claims.

The present disclosure may be based in part on the realization that the increased pressures required for the hydraulic props of a hydraulic shield support system can be achieved by utilizing a plurality of pressure intensifiers, each pressure intensifier being associated with one of the hydraulic props to increase the pressure of the hydraulic fluid that is supplied to the same. In this respect, it has been realized that it is advantageous to be able to individually configure the pressure that is supplied to each hydraulic prop, by a corresponding control of the pressure intensifiers associated with the same. In particular, it has been realized that it is advantageous to provide a pressure sensor for each of the hydraulic props, and control the operation of the individual pressure intensifiers based on the measurement results from the plurality of pressure sensors. In this case, a control unit can monitor the pressures measured by the plurality of pressure sensors, and individually switch off the pressure intensifiers when the desired pressure for the corresponding hydraulic prop has been reached. In this manner, an appropriate pressure profile for the plurality of hydraulic props can be obtained.

The present disclosure is further based on the realization that, by producing the increased pressure directly at the hydraulic prop, the hydraulic pressure for the remaining functions of the hydraulic system can be reduced, i.e., a lower input or system pressure is sufficient to operate said remaining functions. In this respect, it has been realized that by mounting the pressure intensifiers directly at the hydraulic prop, without the need for hoses or the like, the pressure intensifiers can be arranged in a particularly advantageous manner. In this way, the pressure intensifier functions similar to a valve, which can be controlled to directly supply the hydraulic fluid at the desired pressure to the associated hydraulic prop.

The present disclosure is also based in part on the realization that, in some cases, it may be advantageous to provide the pressure intensifier in series with a hydraulically releasable non-return valve that is associated with each hydraulic prop. In this case, the pressure intensifier does not need to be configured such that it can sustain the high pressure from the hydraulic prop, as this function is already performed by the non-return valve. In this configuration, it has been realized that it is advantageous to provide a further non-return valve parallel to the pressure intensifier.

The present disclosure is further based in part on the realization that, in order to obtain a reliable operation of the shield support system, in particular, the pressure intensifiers of the same, it is necessary to provide a pressure intensifier with a configuration that can be realiably operated to increase the low system pressure to the increased pressure required by the hydraulic props. Here, it has been realized that it is advantageous that the pressure intensifier includes a directional control valve that is movably disposed in the pressure intensifier and can selectively connect the working chamber of the pressure intensifier either with the pressure supply that supplies the system pressure or with a drain that discharges fluid to a pressure sink such as a tank or reservoir.

It has been realized that it is advantageous that a further switching valve is provided in the pressure intensifier to reliably switch the directional control valve between its two configurations. In this manner, once the system pressure is supplied to the pressure intensifier, the same can continue to operate in an autonomous manner, until the maximum obtainable pressure or the desired pressure for the associated hydraulic prop has been reached. In this respect, it has also been realized that a reliable switching of the switching valve can be achieved when the same is configured as a mechanically actuated valve that is actuated when the intensifier piston reaches a predetermined position. This advantageous configuration results in a mechanically actuated 3/3 way valve that controls the operation of the pressure intensifier.

The present disclosure is further based on the realization that, in the pressure intensifier having the above-described configuration, it is advantageous when the switching valve is configured as a non-return valve. With this configuration, in case the pressure intensifier stops its operation, i.e., the intensifier piston stops its reciprocating movement, the pressure intensifier can be reactivated by applying the system pressure to the drain of the same, while the input that usually receives the system pressure is connected to the tank or reservoir. This allows re-establishing a predetermined initial configuration of the pressure intensifier, from which it can again start operating normally.

FIG. 1 shows a schematic representation of a hydraulic shield support system 100 for use in deep mining operations. A shield support 1 includes two base runners or shoes 3 located alongside each other on a floor 2, and a shield 5 underpinning the so-called roof 4 and protruding to the working or coal seam (not shown). Shield support 1 further includes a backshield 6 screening the face area. Backshield 6 is articulated to floor shoes 3 by two arms 7. Arms 7, together with two hydraulic props 8 supported on foot joints on base shoes 3, apply sufficient forces to shield 5 to keep the face area free. Hydraulic props 8 arranged, for example, as a pair alongside each other and supported on respective base shoes 3 are telescopic, for example, in several stages, and may be subjected to pressure at either end.

A hydraulic fluid may be supplied either to a pressure chamber in hydraulic props 8 through pipes 13 to press shield 5 against roof 4, thus setting shield support 1 (hereinafter referred to as "set condition"), or to an annulus to retract hydraulic props 8 for removal of hydraulic shield support 1.

Shield support 1 is actuated by an electronic control unit 80, by means of which directional control valves in a valve control bank 40 can be actuated to control operation of shield support 1. Control bank 40 includes a plurality of selectively positionable control valves 41, 47 (see FIG. 2) for each hydraulic prop 8, each of which can be positioned in one or more control positions. A valve chest 14 is mounted on each hydraulic prop 8 and contains a non-return valve 51 (see FIG. 2). Hydraulic pressure is supplied to the hydraulic prop 8 by a pressure supply 12 configured as a pressure pipe, for example, pipe 13. Hydraulic fluid may also be supplied to the annulus of hydraulic prop 8 via another pressure pipe 54 (see FIG. 2). A pressure intensifier 21 (see FIG. 2) is provided for each hydraulic prop 8. In some embodiments, pressure intensifier 21 is mounted to hydraulic prop 8 and/or non-return valve 51 through a mounting portion 15 configured as, for example, a mounting flange connected to or provided integrally with a housing of pressure intensifier 21. In other embodiments, pressure intensifier 21 may be mounted to pipe 13, for example, by a screw connection or the like.

In the shield support system of the present disclosure, at least two hydraulic props 8 are provided. Further, in a deep mining application, the face area is supported by a plurality of hydraulic shield supports 1 located alongside each other. In between each shield support 1 and the working face is a winning system such as, for example, a coal plough or drum cutter loader with a chain conveyor. The winning system can be advanced towards the working face by an advancing ram 16. An angle cylinder 9 is interposed between back shield 6 and shield 5. The supply of pressure to all hydraulic shield supports 1 takes place through a hydraulic supply system not shown in detail, wherein a pump may be provided for one or more of shield supports 1 to provide hydraulic fluid to the hydraulic props 8 of shield supports 1.

Figure 2:
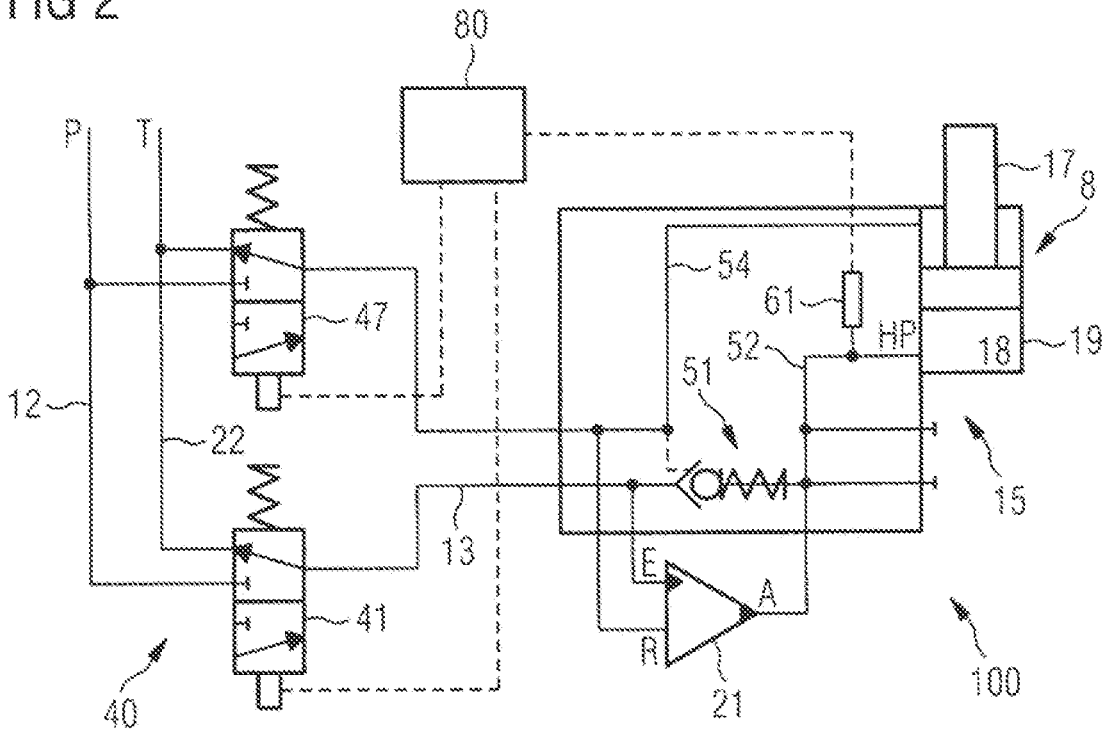
FIG. 2 shows a schematic diagram of a hydraulic circuit of a shield support in accordance with the present disclosure.

As will be described in more detail below with respect to FIGS. 2 and 3, a plurality of pressure intensifiers 21 are provided for the plurality of hydraulic props 8. FIG. 2 shows a schematic representation of a hydraulic circuit of hydraulic shield support system 100 configured to supply hydraulic fluid to one of the plurality of hydraulic props 8.

As shown in FIG. 2, system 100 includes a hydraulic fluid supply 12 configured to supply hydraulic fluid at a first hydraulic pressure P, which may correspond to the system pressure, to pressure intensifier 21 via control valve 41 and pressure pipe 13. As also shown in FIG. 2, system 100 also includes a pressure sink T, such as a tank or reservoir, to which hydraulic fluid from hydraulic prop 8 can be discharged via pressure pipe 54 and control valve 47.

As shown in FIG. 2, each pressure intensifier 21 is fluidly connected between hydraulic fluid supply 12 and hydraulic prop 8, and configured to supply hydraulic fluid at an increased pressure HP to associated hydraulic prop 8. As shown in FIG. 2, pressure intensifier 21 has a low-pressure input E via which hydraulic fluid supplied from hydraulic fluid supply 12 is supplied to pressure intensifier 21, a high-pressure output A via which hydraulic fluid at an increased pressure is supplied to hydraulic prop 8, and a drain R, via which hydraulic fluid is discharged to pressure sink T. The operation of pressure intensifier 21 will be described in more detail in the following.

As shown in FIG. 2, hydraulic fluid from hydraulic fluid supply 12 at system pressure P is supplied to low-pressure input of pressure intensifier 21 via control valve 41 and pipe 13. Control valve 41 may be movable between two valve positions, under a control of control unit 80. In a first valve position, not shown in FIG. 2, control valve 41 fluidly connects low-pressure input E of pressure intensifier 21 with hydraulic fluid supply 12 to supply hydraulic fluid at pressure P. In a second position, which is shown in FIG. 2, control valve 41 fluidly connects low-pressure input E of pressure intensifier 21 with the pressure sink T via a return line 22.

As further shown in FIG. 2, high-pressure output A of pressure intensifier 21 is fluidly connected to a pressure chamber 18 of hydraulic prop 8, which pressure chamber is defined between a housing 19 and a bottom surface of a piston 17 provided in housing 19, by a pressure pipe 52. Piston 17 and housing 19 further define a second chamber, for example, an annulus, of hydraulic prop 8, in a manner that is known to the skilled person. Said annulus is fluidly connectable to pressure sink T via pressure pipe 54 and control valve 47. In this manner, hydraulic fluid in the annulus of hydraulic prop 8 can be selectively discharged to pressure sink T via a corresponding operation of control valve 47 by control unit 80. Control valve 47 is also configured as a valve with two positions. In a first position, which is not shown in FIG. 2, the annulus of hydraulic prop 8 is fluidly connected to hydraulic fluid supply 12 to receive the system pressure P, and in the second position shown in FIG. 2, the annulus is fluidly connected to pressure sink T. As shown in FIG. 2, an assembly including non-return valve 51 and pressure intensifier 21 is mounted to housing 19 of hydraulic prop 8, for example, via an appropriate mounting flange of mounting portion 15.

As also shown in FIG. 2, non-return valve 51 is arranged between pressure pipe 13 and pressure pipe 52, i.e., between control valve 41 and hydraulic prop 8. In addition, non-return valve 51 is configured to be hydraulically releasable by the hydraulic pressure of the hydraulic fluid in pressure pipe 54, in particular, when the hydraulic pressure in pressure pipe 54 is the system pressure P.

System 100 also comprises a pressure sensor 61 configured to measure the pressure of hydraulic fluid that is supplied to pressure chamber 18 of hydraulic prop 8. Pressure sensor 61 may be arranged along pressure pipe 52 at a position downstream of pressure intensifier 21, and is configured to measure the pressure of the fluid supplied to pressure chamber 18 and output a corresponding measurement result to control unit 80. Control unit 80 is configured to set a desired pressure of the hydraulic fluid to be supplied to hydraulic prop 8, receive the pressure measured by pressure sensor 61, and switch control valve 41 to stop supplying fluid at system pressure P to pressure intensifier 21 when the measured pressure reaches the desired pressure for associated hydraulic prop 8.

It will be appreciated that control unit 80 is configured to set a plurality of desired pressures for the plurality of hydraulic props 8, in particular, such that at least two of the set desired pressures are different from each other. With this configuration, a pressure profile with different pressures for different hydraulic props 8 can be obtained, by switching off the respective pressure intensifiers 21 when the desired pressures have been reached. Therefore, it is understood that a pressure sensor 61 is provided for each hydraulic prop 8 and configured to detect the pressure of hydraulic fluid supplied to the same. Likewise, control unit 80 is configured to receive all pressures measured by the plurality of pressure sensors 61, and individually actuate the respective control valves 41 and, optionally, 47.

An exemplary operation of the system shown in FIG. 2 will be explained in the following. At the start of supplying pressure to hydraulic prop 8 to set the same, control unit 80 actuates control valves 41, 47 such that the system pressure P is supplied to low-pressure input E of pressure intensifier 21. Further, control valve 47 is actuated to fluidly connect the annulus of hydraulic prop 8 to pressure sink T. In this configuration, the drain R of pressure intensifier 21 is also fluidly connected to pressure sink T via its connection to pressure pipe 54. Pressure intensifier 21 therefore begins operating to increase system pressure P to the desired high pressure HP. In particular, hydraulic fluid at an increased pressure is supplied to pressure chamber 18 of hydraulic prop 8 from high-pressure output A of pressure intensifier 21. Accordingly, piston 17 of hydraulic prop 8 begins to extend from housing 19 of hydraulic prop 8. A back flow of hydraulic fluid at the increased pressure from the pressure chamber of hydraulic prop 8 is prevented by non-return valve 51.

Pressure sensor 61 detects the value of the increased pressure that is supplied to pressure chamber 18 of hydraulic prop 8, and outputs the measurement result to control unit 80. Control unit 80, which has previously set a desired pressure for the hydraulic fluid to be supplied to hydraulic prop 8, receives the measured pressure and compares the same to the previously set desired pressure. When the measured pressure reaches the desired pressure, control unit 80 actuates control valve 41 to fluidly connect low-pressure input E of pressure intensifier 21 with tank or reservoir T. Accordingly, the system pressure P is no longer supplied to pressure intensifier 21, and the same stops its operation. Therefore, the high pressure HP will no longer increase.

When piston 17 is to be retracted, control unit 80 actuates control valve 47 to fluidly connect the annulus of hydraulic prop 8 to hydraulic fluid supply 12. The pressure P in line 54 actuates non-return valve 51, and piston 17 retracts.

Figure 3:
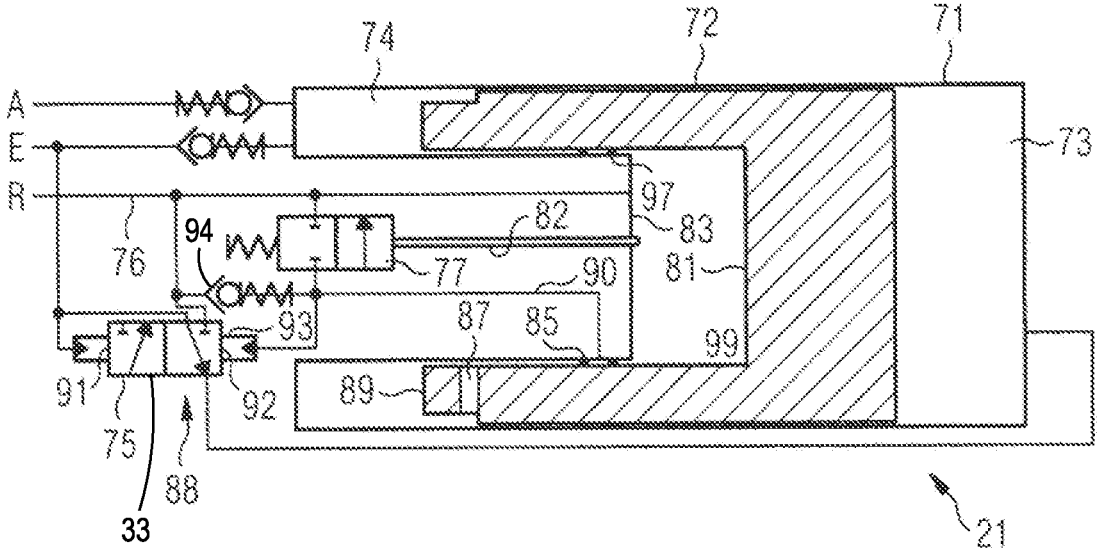
FIG. 3 shows a schematic representation of a pressure intensifier in accordance with the present disclosure.

FIG. 3 shows an exemplary embodiment of pressure intensifier 21. As shown in FIG. 3, pressure intensifier 21 includes a housing 71 and an intensifier piston 72 moveably disposed in housing 71. Intensifier piston 72 defines a low-pressure or working chamber 73 and a high-pressure chamber 74 on opposite sides of the same. Intensifier piston 72 is configured to increase the pressure of hydraulic fluid in high-pressure chamber 74 by moving into the same when hydraulic fluid at system pressure P is supplied to low-pressure chamber 73. In the exemplary embodiment shown in FIG. 3, intensifier piston 72 is generally cup-shaped, with the annular side wall 89 of the same moving into the correspondingly annular-shaped high-pressure chamber 74.

Further, pressure intensifier 21 includes a valve assembly accommodated in a valve housing 83 that is mounted to the end of housing 71 that is opposite to low-pressure chamber 73. In particular, valve housing 83 defines the inner surface of annular high-pressure chamber 74. A pair of seals 85, 97, which will be described in more detail below, are provided between the outer surface of valve housing 83 and an inner peripheral surface of wall 89 of intensifier piston 72. An inner space 99 is defined between an inner bottom surface 81 of intensifier piston 72 and the opposing outer bottom surface of valve housing 83.

As shown in FIG. 3, a reduced diameter distal end portion is formed in side wall 89 of intensifier piston 72 and provided in high-pressure chamber 74. At least one radial bore 87 is formed in the reduced diameter distal end portion of side wall 89 to be in fluid communication with high-pressure chamber 74.

Valve housing 83 comprises a fluid inlet 90 formed in an outer peripheral surface of valve housing 83 that defines an inner surface of high-pressure chamber 74. Fluid inlet 90 is provided between seals 85, 97. Seals 85, 97 and radial bore 87 are provided at positions such that, when intensifier piston 72 has reached its end position in low-pressure chamber 73 (the rightmost position in FIG. 3), fluid inlet 90 is fluidly communicated with high-pressure chamber 74 via radial bore 87, with inner space 99 defined between intensifier piston 72 and valve housing 83 being fluidly separated from high-pressure chamber 74 by seal 97. As intensifier piston 72 moves into high-pressure chamber 74, it reaches a position where radial bore 87 moves past seal 85 to fluidly separate fluid inlet 90 from high-pressure chamber 74.

As shown in FIG. 3, valve assembly 88 includes a directional control valve 75 and a switching valve 77. Directional control valve 75 is movably disposed in pressure intensifier 21, i.e., valve housing 83, and is movable between a first control valve position in which low-pressure chamber 73 is fluidly connected to low-pressure input E of pressure intensifier 21, and a second control valve position in which low-pressure chamber 73 is fluidly connected to drain R. In some embodiments, directional control valve 75 is concentrically arranged inside intensifier piston 72. Further, switching valve 77 is configured to switch directional control valve 75 between the first control valve position and the second control valve position. In particular, switching valve 77 is configured to switch directional control valve 75 from the first control valve position to the second control valve position when intensifier piston 72 reaches a predetermined position in high-pressure chamber 74.

In the exemplary embodiment, switching valve 77 is a mechanically actuated valve that is mechanically actuated by intensifier piston 72 upon reaching the predetermined position. As will be described in more detail below, in the exemplary embodiment shown in FIG. 3, the predetermined position of intensifier piston 72 is its end position within high-pressure chamber 74. In this end position, bottom surface 81 of intensifier piston 72 contacts a contact element 82 of switching valve 77 and actuates the same to move from a first valve position to a second valve position to switch directional control valve 75 from the first control valve position to the second control valve position. This will be described in more detail below.

As shown in FIG. 3, inner space 99 is fluidly connected to drain R. Further, switching valve 77 is fluidly connected between a return line 76 that connects inner space 99 with drain R, and a control chamber 93 of directional control valve 75, which will be described in more detail below. In the first valve position, when contact element 82 is not contacted by intensifier piston 72, switching valve 77 fluidly separates control chamber 93 from return line 76. On the other hand, in the second valve position, when intensifier piston 72 contacts contact element 82, switching valve 77 fluidly connects return line 76 to control chamber 93.

Directional control valve 75 is, in the exemplary embodiment, a 3/2 directional control valve. Directional control valve 75 includes a movable element 33 having a first pressure receiving surface 91 and a second pressure receiving surface 92 with an area that is greater than an area of the first pressure receiving surface 91. First pressure receiving surface 91 is exposed to hydraulic fluid at system pressure P, and second pressure receiving surface is exposed to hydraulic fluid in control chamber 93. As already explained, control chamber 93 is selectively in fluid communication with fluid inlet 90 or drain D, depending on the switching state of switching valve 77. A non-return valve 94 is arranged between fluid inlet 90 and return line 76.

As shown in FIG. 3, in the first control valve position, directional control valve 75 fluidly connects low-pressure input E to low-pressure chamber 73. On the other hand, in the second control valve position, directional control valve 75 fluidly connects drain R to low-pressure chamber 73. Therefore, in the first control valve position, low-pressure chamber 73 is supplied with hydraulic fluid at system pressure P, whereas in the second control valve position hydraulic fluid in low-pressure chamber 73 is discharged towards drain R.

A working cycle of exemplary pressure intensifier 21 will be explained in the following.

In an initial position of pressure intensifier 21, intensifier piston 72 is fully retracted into low-pressure chamber 73. In this state, intensifier piston 72 is not in contact with contact element 82 of switching valve 77. Accordingly, switching valve 77 is in the position shown in FIG. 3, i.e., does not connect return line 76 to control chamber 93 of directional control valve 75. Radial bore 87 is positioned between seals 85, 97 and fluidly connects high-pressure chamber 74 to control chamber 93 of directional control valve 75 via fluid inlet 90. As second pressure receiving surface 92 of directional control valve 75 is greater than first pressure receiving surface 91, which is exposed to fluid at system pressure P, and second pressure receiving surface 92 is also exposed to fluid at system pressure P via fluid inlet 90, directional control valve 75 is in the position shown in FIG. 3. Accordingly, low-pressure chamber 73 is connected to low-pressure inlet E via directional control valve 75. In this state, high-pressure chamber 74 is completely filled with hydraulic fluid at system pressure P. As the area of the bottom surface of intensifier piston 72 is greater than the annular front surface of wall 89 of the same, intensifier piston 72 begins moving towards high-pressure chamber 74.

Accordingly, the pressure of the fluid in high-pressure chamber 74 increases, and the fluid at the increased pressure is supplied to hydraulic prop 8 via high-pressure output A. Once intensifier piston 72 has moved into high-pressure chamber 74 by a predetermined amount, radial bore 87 moves past seal 85. Accordingly, control chamber 93 of directional control valve 75 is fluidly separated, and fluid at system pressure P remains inside control chamber 93. Therefore, directional control valve 75 remains in the position that is shown in FIG. 3. In addition, low-pressure chamber 73 continues to be fluidly connected to low-pressure inlet E. Therefore, intensifier piston 72 continues to move into high-pressure chamber 74. This configuration is shown in FIG. 3.

When intensifier piston 72 reaches a predetermined position, in particular, its end position in high-pressure chamber 74, bottom surface 81 of intensifier piston 72 contacts contact element 82 of switching valve 77. Due to this, control chamber 93 of directional control valve 75 is fluidly connected to drain R. Therefore, the pressure acting on pressure receiving surface 91 can move directional control valve 75 to its second valve position, to thereby fluidly connect low-pressure chamber 73 to drain R.

In some embodiments, the fluid connection between low-pressure chamber 73 and drain R can be via a hollow piston rod along which intensifier piston 72 moves. For example, the hollow piston rod may be connected to or integrally formed with directional control valve 75.

In this configuration, fluid at system pressure P enters high-pressure chamber 74 and acts on the annular front surface of wall 89 of intensifier piston 72. Accordingly, intensifier piston 72 moves towards low-pressure chamber 73, and high-pressure chamber 74 is filled with fluid at system pressure P. In this state, control chamber of directional control valve 75 remains at the pressure of pressure sink T. Likewise, directional control valve 75 remains in its second valve position.

As soon as radial bore 87 passes seal 85, control chamber 93 of directional control valve 75 is again fluidly connected to high-pressure chamber 74. Accordingly, fluid at system pressure P acts on second pressure receiving surface 92, resulting in that directional control valve 75 is again moved to its first valve position (the position that is shown in FIG. 3). As a consequence, low-pressure chamber 73 is again fluidly connected to low pressure inlet E, and intensifier piston 72 again begins its movement into high-pressure chamber 74 to increase the pressure of fluid therein.

As will be readily appreciated by the skilled person, the reciprocating movement of intensifier piston 72 in housing 71 results in fluid at high pressure HP being delivered to pressure chamber 18 of hydraulic prop 8, either until a maximum obtainable or allowable pressure is reached, or control unit 80 actuates control valve 41 when the set desired pressure for hydraulic prop 8 has been reached, in response to the measurement by pressure sensor 61.

With the above-described configuration, a desired pressure profile can be obtained for the plurality of hydraulic props 8 of hydraulic support system 100 by controlling the individual pressure intensifiers 21 associated with the plurality of hydraulic props 8 in an appropriate manner.

Figure 4:
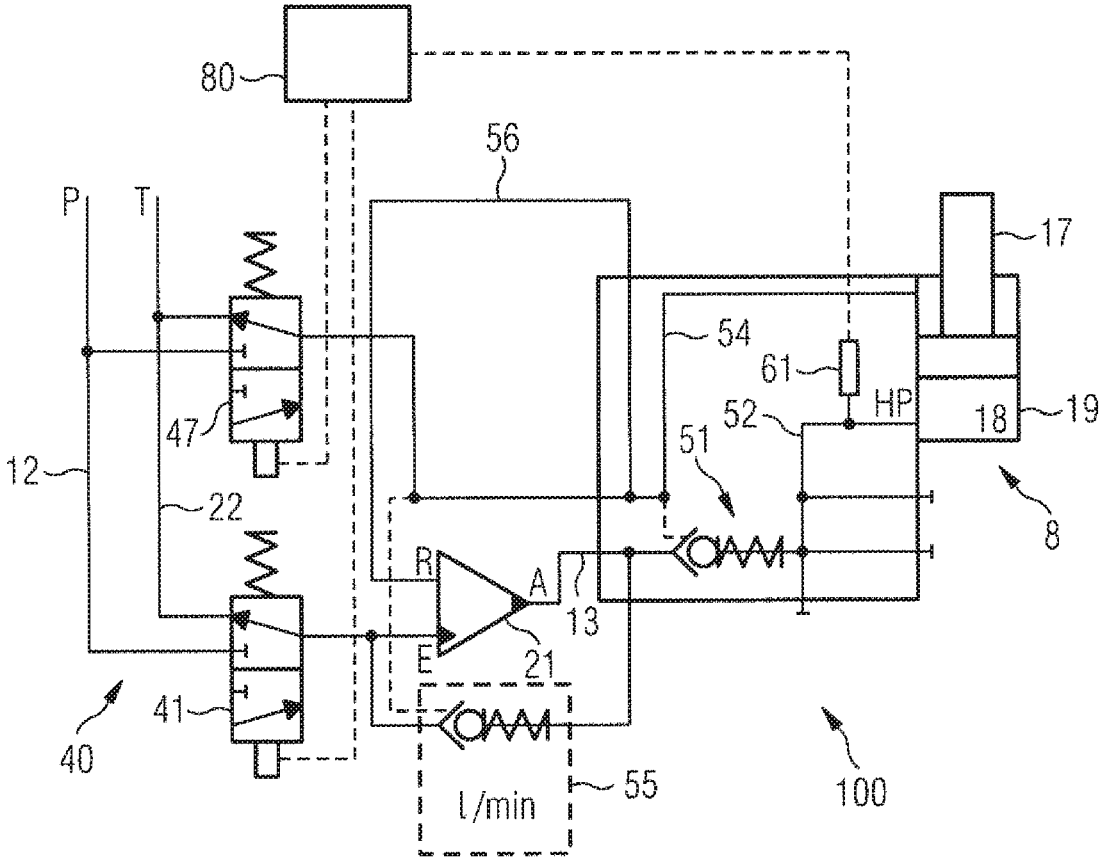
FIG. 4 shows a schematic diagram of another hydraulic circuit of a shield support in accordance with the present disclosure.

FIG. 4 shows an alternative embodiment of hydraulic shield support system 100 including a plurality of pressure intensifiers 21 respectively associated with a plurality of hydraulic props 8. The configuration of the system shown in FIG. 4 is essentially the same as for the system shown in FIG. 2, such that only the differences will be described.

As shown in FIG. 4, the system in the alternative embodiment differs from the system shown in FIG. 2 in that pressure intensifier 21 is fluidly connected in series between non-return valve 51 and control valve 41. Accordingly, it is advantageous to provide an additional non-return valve 55 that is connected between control valve 41 and non-return valve 51 in parallel to pressure intensifier 21. The reason for this is that sufficient flow-rate is required in order to avoid impacting the cycle time of pressure intensifier 21 in a negative manner. In some embodiments, the additional pressure intensifier non-return valve 55 has a flow-rate that is preferably greater than or equal to the flow-rate of non-return valve 51 and/or control valve 41. Otherwise, the same effects that are obtained for the embodiment shown in FIG. 2 can be obtained by the embodiment shown in FIG. 4.

INDUSTRIAL APPLICABILITY

The industrial applicability of the systems and methods disclosed herein will be readily appreciated from the foregoing discussion. One exemplary application is an application in an underground mining system, for example, in a self-advancing roof support system of an underground mining system.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the scope of disclosure more generally. All methods described herein may perform in any suitable order unless otherwise indicated herein or clearly contradicted by context.

Accordingly, this disclosure includes all modifications and equivalences of the subject-matter recited in the claims appended hereto as permitted by applicable law. Moreover, any combination of the above-described elements in all possible variations thereof is encompassed by the disclosure unless otherwise indicated herein or clearly contradicted by context.

Although the preferred embodiments of this disclosure have been described herein, improvements and modifications may be incorporated without departing from the scope of the following claims.

The invention claimed is:

1. A hydraulic shield support system adapted for underground mining, the system comprising:

a plurality of length-adjustable hydraulic props configured to support a shield;

a hydraulic fluid supply configured to supply hydraulic fluid at a first pressure;

a plurality of pressure intensifiers fluidly connected between the hydraulic fluid supply and each of the hydraulic props, each of the plurality of pressure intensifiers being configured to supply hydraulic fluid at an increased second pressure to the associated hydraulic prop, each of the plurality of pressure intensifiers includes a drain output configured to discharge the hydraulic fluid from the pressure intensifier, the drain output fluidly connected between the associated hydraulic prop and a pressure sink, wherein the drain output is fluidly connected downstream of hydraulic fluid discharged from the hydraulic prop;

a plurality of control valves configured to selectively supply the hydraulic fluid from the hydraulic fluid supply to the respective pressure intensifiers to operate the same;

a plurality of pressure sensors configured to measure the pressure of the hydraulic fluid supplied to each of the hydraulic props by the associated pressure intensifier; and a control unit configured to:

set a plurality of desired pressures of the hydraulic fluid to be supplied to the plurality of hydraulic props, at least two of the set desired pressures being different from each other;

receive the pressures measured by the plurality of pressure sensors; and switch the plurality of control valves to stop supplying fluid at the first pressure to each of the pressure intensifiers when the measured pressure reaches the set desired pressure for the associated hydraulic prop.

2. The system of claim 1, further comprising:

a hydraulically releasable non-return valve fluidly connected between each control valve and the associated hydraulic prop, wherein the associated pressure intensifier has a low-pressure input configured to receive the hydraulic fluid at the first pressure, the low-pressure input being fluidly connected between the control valve and the non-return valve, and a high-pressure output configured to output the hydraulic fluid at the increased second pressure, the high-pressure output being fluidly connected between the non-return valve and the associated hydraulic prop.

3. The system of claim 2, wherein each pressure intensifier is mounted to at least one of the associated hydraulic prop and the associated hydraulically releasable non-return valve through a mounting portion.

4. The system of claim 1, further comprising:

a hydraulically releasable non-return valve fluidly connected between each control valve and the associated hydraulic prop, wherein the associated pressure intensifier has a low-pressure input configured to receive the hydraulic fluid at the first pressure, the low-pressure input being fluidly connected to the control valve, and a high-pressure output configured to output the hydraulic fluid at the increased second pressure, the high-pressure output being fluidly connected to the non-return valve, such that the pressure intensifier is fluidly connected in series with the non-return valve between the control valve and the associated hydraulic prop.

5. The system of claim 4, further comprising:

a pressure intensifier non-return valve fluidly connected in parallel to the pressure intensifier between the control valve and the non-return valve.

6. The system of claim 5, wherein the pressure intensifier non-return valve has a flow-rate that is greater than or equal to the flow rate of the non-return valve and/or the control valve.

* * * * *